137-13 SR
3/9/76 XR 3,942,766

United States Patent [19]
Lage

[11] 3,942,766
[45] Mar. 9, 1976

[54] PROCESS AND ARRANGEMENT FOR PRODUCING A STRONG TURBULENCE IN AT LEAST ONE FLUID OR QUASI-FLUID MEDIUM

[76] Inventor: James R. Lage, Rinikerstrasse 107, 5222 Umiken, Switzerland

[22] Filed: Nov. 18, 1974

[21] Appl. No.: 524,964

Related U.S. Application Data

[63] Continuation-in-part of Ser. No. 449,482, March 8, 1974, abandoned.

[52] U.S. Cl. ..... 259/4; 137/13; 137/604
[51] Int. Cl.[2] ..... B01F 5/00
[58] Field of Search ..... 137/1, 13, 604; 259/4

[56] References Cited

UNITED STATES PATENTS

| | | | |
|---|---|---|---|
| 3,730,494 | 5/1973 | Sterline | 259/4 X |
| 3,741,533 | 6/1973 | Winn | 259/4 |

*Primary Examiner*—Alan Cohan
*Attorney, Agent, or Firm*—Watson, Cole, Grindle & Watson

[57] ABSTRACT

A process and arrangement for producing a strong turbulence in at least one fluid or quasi-fluid medium wherein the medium flows along at least two confined and adjacent stream paths, the streams being rotated in opposite directions within their paths so as to cause the flow components thereof to be directed opposite one another, and the streams laterally graze one another within a discharge chamber as they begin to move outwardly of their paths. The streams are suddenly brought into contact with each other within the chamber whereupon intensive movements of the medium particles develop transversely to the flow directions along fictitious planes of contact between the two streams as the result of a delay in speed of the flow components of the streams, whereby a strong turbulence develops with a most intimate mixing of the two streams.

12 Claims, 8 Drawing Figures

PROCESS AND ARRANGEMENT FOR PRODUCING A STRONG TURBULENCE IN AT LEAST ONE FLUID OR QUASI-FLUID MEDIUM

This application is a Continuation-In-Part of my copending application Ser. No. 449,482, filed Mar. 8, 1974, now abandoned.

This invention relates to a process for producing a strong turbulence in at least one fluid or a quasi-fluid medium, and an arrangement for carrying out such process.

Physical, chemical or technical processes as used continuously in procedural techniques are improved, accelerated or even basically made possible by the use of turbulence. Examples for such processes are the mixing of substances, chemical reactions, or the introduction or diversion of heat. Such turbulences can be produced in many ways in the participating media as, for example, by increase of the Reynolds number, by a specific shaping of the container or lines of conduction, increase of the flow velocity, insertion of resistance or turbu-elements, flow guidance in the rays, etc. In the production of turbulence in such manner, however, the underlying disadvantage is that they all require high power consumption or effect great losses of energy and, in most instances, the achievable degree of turbulence is not foreseeable and not sufficiently great.

The present invention is premised on the objective of creating a strong turbulence in fluids or quasi-fluid media with the simplest possible means and without any unnecessary loss of energy. In such instance, it is to be understood that the fluid or quasi-fluid media referred to include all substances which are liquid or gaseous, or which consist of a mixture of liquid or gaseous substances of some type. They can be homogeneous or heterogeneous and can also contain particles of fatty substance. Furthermore, viscous substances, plasma of different types, agglomerations of electrons, etc. are included. In short, all substances which are able to totally flow, and the mass particles of which can be shifted in relation to one another by flow forces, are considered to be among the fluids and quasi-fluid media referred to herein.

In carrying out the objective according to the invention, the medium or media are guided in two paths, which have oppositely directed flow components and which, after grazing laterally, are suddenly brought into contact with one another. As a result, intensive movements of the fluid or quasi-fluid particles develop transversely to the plane of contact, or at the fictitious plane of contact, of the two flow paths by retardation of speed of the two flow components oppositely directed to one another, as a result of which a strong turbulence develops with a most homogeneous mixing of the two streams.

In accordance with one arrangement in carrying out this process, at least two supply channels are provided for the two streams of the one medium, or two media, or more, which open into the fictitious plane of contact, and an outflow or discharge channel is further provided for the turbulent flow of the medium or media.

More particularly, such an arrangement includes three parallel and spaced circular discs having a common axis, the middle disc having a smaller diameter compared to the outer ones, wherein the discs constitute the inflow channels for the two streams of the medium which flow outwardly between two discs with the streams rotating in opposite directions. After the medium flows outwardly of the middle disc, the two streams contact one another so that the two outer larger discs then constitute the outflow or discharge channel for the turbulence flow of the medium.

As a result, it is possible to create a turbulence of a high degree in the participating streams of medium or media in a novel manner. At the same time the two streams can flow in a straight line and can be directed against one another, or they can meet at an angle--which also will be the case whenever a stream of medium or even both streams are guided rotatingly, also radially or axially--but they must have flow components which are directed oppositely in relation to one another. During the mutual sudden contact of the two streams at the fictitious plane of contact, a type of heating effect occurs in addition to that caused by friction, as a result of which the two flow components directed oppositely to one another are eliminated without delay and their originally contained flow energy is changed into turbulence. There merely remains a residual translation flow, which serves to eliminate--effectively in a direction deviating from the two original directions of flow--the turbulent stream of the medium developed through the mixing, the speed of which is determined mainly by the free path-through surface.

A measure for the turbulence that can be achieved according to this process is the quickest possible delay of speed of the two flow components directed against one another. This delay is best accomplished whenever the masses of the two streams of medium are equal, with their speeds likewise being equal; or in the case of unequal masses, if their flow energies are the same. If these assumptions do not occur, then the level of the achievable turbulence drops with the increase of the variability of the above-mentioned values of influence. Likewise, the achievable turbulence will decrease greatly whenever not all of the oppositely directed flow components are at least equally as large as their respective other assigned flow component. Naturally, a certain turbulence will still be produced, even in the latter instance, but a large part of the available energy will not have been used effectively, but will merely have served for a quick elimination of the stream of the medium and is thus lost for the production of the highest possible turbulence which is the actual objective.

The turbulence produced in this manner can be used in the case of all physical, chemical and technical processes where mass particles turbulently moved in a stream of the medium are of advantage. Such processes included mixing, homogenizing. dispersing, reacting, gassing, evaporating, vaporizing; also catalytic processes, heat exchange, treatment of plasma in the atomic technique, etc.

The above and other objects of the invention will become more apparent from the following detailed description of the invention when taken in conjunction with the accompanying drawings wherein.

Figure 1:
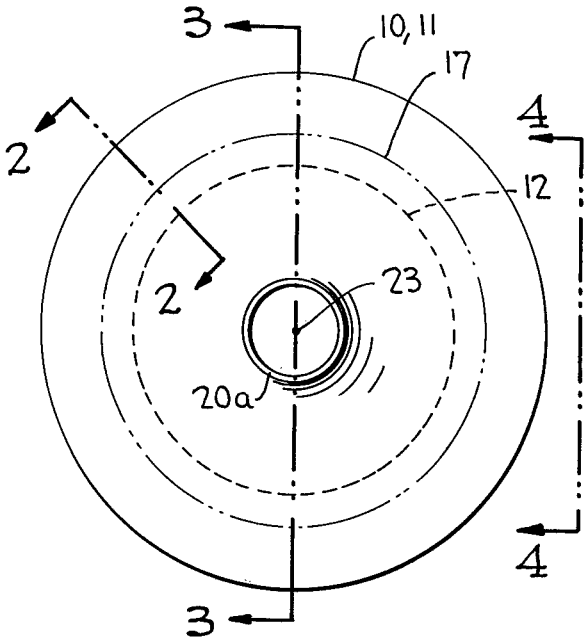
FIG. 1 is a plan of the arrangement according to the invention.
Figure 2:
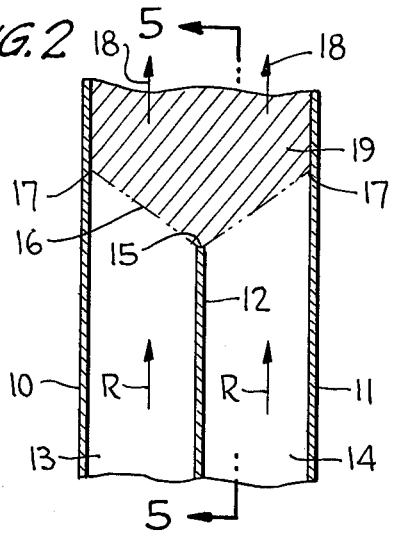
FIG. 2 is an enlarged sectional view of the FIG. 1 arrangement taken along line 2—2 thereof.
Figure 4:
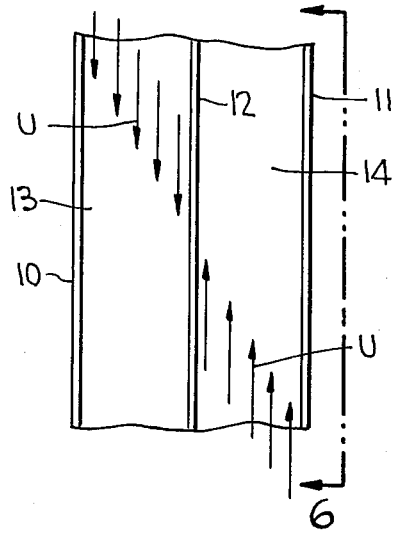
FIG. 4 is a partial side view taken along line 4—4 of FIG. 1.
Figure 3:
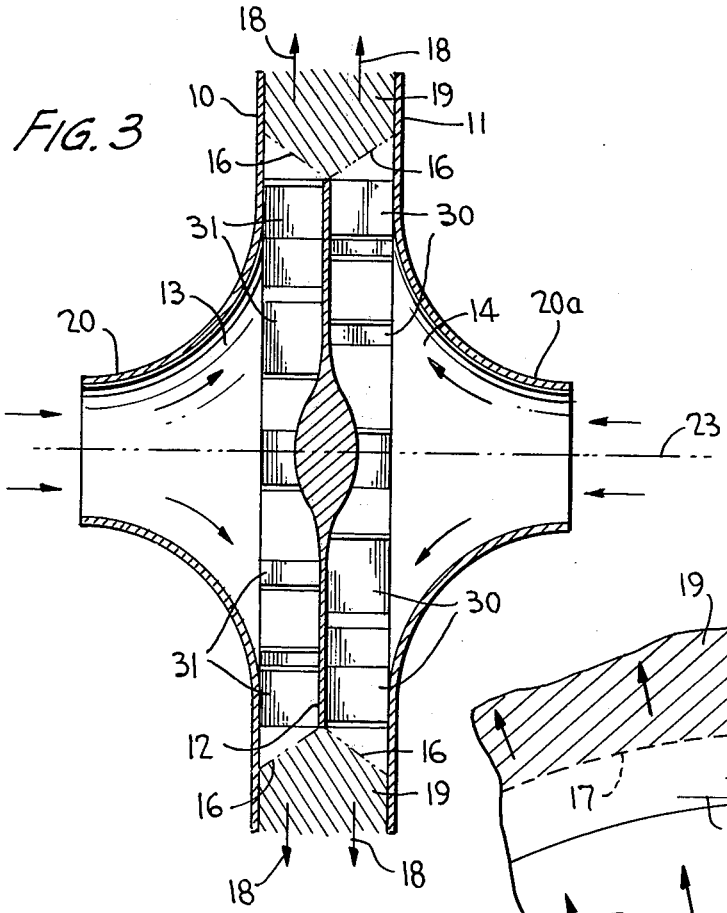
FIG. 3 is a cross-sectional view taken along line 3—3 of FIG. 1.

The arrangement according to FIGS. 1 to 6 essentially includes two outer circular discs 10, 11 and a middle circular disc 12, each of which are disposed in spaced, parallel relation to one another along a common axis 23. As shown in FIGS. 1 and 3, disc 12 has a smaller diameter as compared to discs 10 and 11 of equal diameter. The space between discs 10 and 12 forms one inflow channel 13, and the space between discs 12 and 11 forms another inflow channel 14 respectively for two streams of medium or media separated from one another by disc 12. The medium or mass streams are initially conducted from pumps, compressors, blowers or any applicable pressure head (not shown) through ducts or tubes 20 and **20*a* provided on respective discs 10 and 11 as shown in FIG. 3. These streams are therefore guided between the discs as shown by the arrows and flow around the axis 23** thereof, but rotate in counter directions (see FIG. 4) and flow simultaneously radially outwardly (see FIG. 2), as a result of which in totality flat spiral parts result. They are similar because the peripheral flow components U of both streams directed oppositely to one another are equal (as shown in FIG. 4 by the same length of the arrows), and because the somewhat smaller radial flow components R of both streams are likewise equal.

Rotation of the streams in counter or opposite directions after entering through ducts 20 and **20*a* is effected by means of, for example, annular vanes 30 and 31** with blades directed respectively in opposite directions. The mass streams are conducted to flow radially outwardly and through the rotation inducing vanes (or through some other common rotation inducing means which may be substituted therefor).

As soon as the rotating streams of the medium or media pass radially beyond disc 12, both parts of the mass streams represent two counter-rotating fluid bodies with an escaping radial flow vector. After passing through the vanes, the rotating streams suddenly contact each other by grazing each other laterally at a fictitious plane of contact, which can be seen as the continuation of disc 12 in a radial direction. The hitherto undisturbed streams now rub against each other and the peripheral speed thereof is delayed, in the ideal instance for both streams, up to about zero. The energy which is thereby eliminated is converted into an intensively fluctuating chaotic movement of the mass particles in a transverse direction to the fictitious plane of contact. These movements in their entirety form a very marked strong turbulence. At the same time, the two streams of medium are most intimately mixed with one another.

Figure 5:
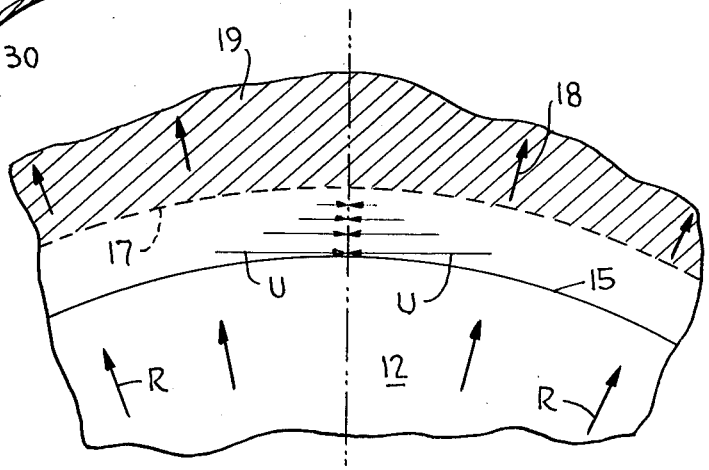
FIG. 5 is a view taken along line 5—5 of FIG. 2.

These flow components have been at least partially symbolized in the drawings. The decrease and disappearance of the peripheral flow components U is indicated in FIG. 5 by the diminishing size of the arrows in an outward direction. The turbulence spreads immediately from peripheral edge 15 of disc 12 towards discs 10 and 11. Approximately starting from the two fictitious peripheral planes 16, which contact the discs 10 and 11 along lines 17, there is now only one stream of a medium left as a result of the simultaneous mixing of the two streams thereof. This one stream is strongly turbulent and will remain so, and is carried off radially in the direction of arrows 18 by the discharge channel 19 now formed by the two outer larger discs 10 and 11.

It should be noted that technically the invention will be quite effective when the peripheral flow components U of both streams, suddenly contacting each other at peripheral planes 16, are made equal to or greater than the radial flow components R thereof. However, even when the peripheral flow components U are made smaller than the radial flow components R, a turbulence will nevertheless be produced although it will gradually decrease according to the relationship U/R. The degree of flow velocities is based on the given energy head and the width of the area of the distance between walls 10 and 11.

Figure 6:
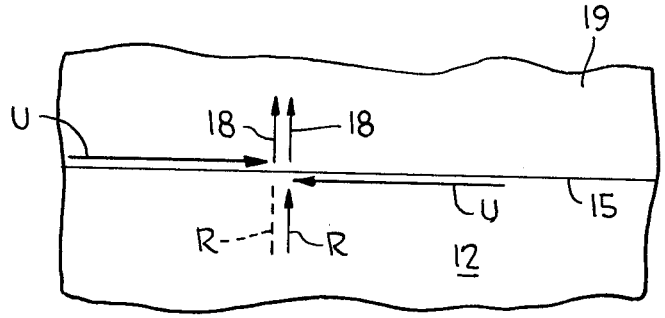
FIG. 6 is a view at a slightly enlarged scale taken along line 6—6 of FIG. 4.

In FIG. 6, the peripheral components U of the two streams of media are shown, in relation to disc 12 and its edge 15, immediately prior to their mutual contact. The developing turbulent stream of the medium is carried off in the direction of arrows 18 by discharge channel 19.

The two streams of the medium can be of different types, as for example the mixture of two media, although they can also originate from the same source. Such will be the case whenever it is intended to shift a medium, for example, for the improvement of the heat transfer, into high turbulence, or generally everywhere, in which a highly turbulent movement in a medium will be useful. If the flow energy $m_1v_1^2$ of one stream of the medium is not equally as large as the flow energy $m_2v_2^2$ of the other stream of the medium, whereby $m_1$, $m_2$ signify the masses of the media and $v_1$, $v_2$ signify their speeds of flow prior to their contact, then only the smaller of the two flow components directed oppositely to one another will be reduced down to zero. Therefore, since there remains a residue of the other peripheral component, the discharge direction of the turbulent medium stream deviates correspondingly from the radial.

The turbulence can be utilized effectively in a discharge channel, for example, by feeding in of particles of substance or of finely dispersed substances. Likewise, the wall or walls of the discharge channel may form the heat exchange surfaces of a heat exchanger. Another possibility is to form the wall of the discharge channel as a catalyst, in which it is made entirely of a corresponding raw material, or wherein its side facing the turbulent medium is coated with such raw material.

It is also possible to effect rotation of the two streams of media in a radially inward direction instead of radially outwardly. Accordingly, the turbulent stream of the medium, which can be carried away in almost any desired direction, will be reversed outwardly of the discs and is conducted inwardly of the discs again in a similar manner, as a result of which its turbulence is still further increased. It is also possible to dispose several of the aforedescribed arrangements on the same axis so that the medium flows in parallel or in series between the discs.

Also, the combination of a rotating medium and of one which moves ahead in a straight line is also made possible by the present invention. Furthermore, both media can flow in a straight line toward each other and can flow off laterally thereto, which will result in an arrangement that is T-shaped in form.

The optimum size ratios for the discs in accordance with the present arrangement are best determined experimentally. They depend on the various values of influence: the desired turbulence, the viscosity of the medium or media, the type of arrangement of the streams, the amount of power available for the production of the velocity, etc. The arrangements are of a manifold nature, but they are relatively simple in their construction, since basically the flow paths of the two media can be produced by correspondingly directed pipelines and/or by nozzles of the proper type.

Figure 7:
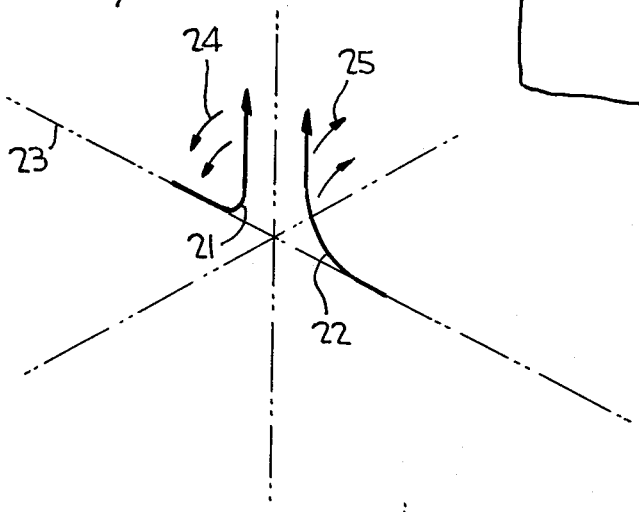
FIGS. 7 and 8 schematically illustrate the principle of the development of the rotation of two streams of medium with a reversed direction of rotation.
Figure 8:
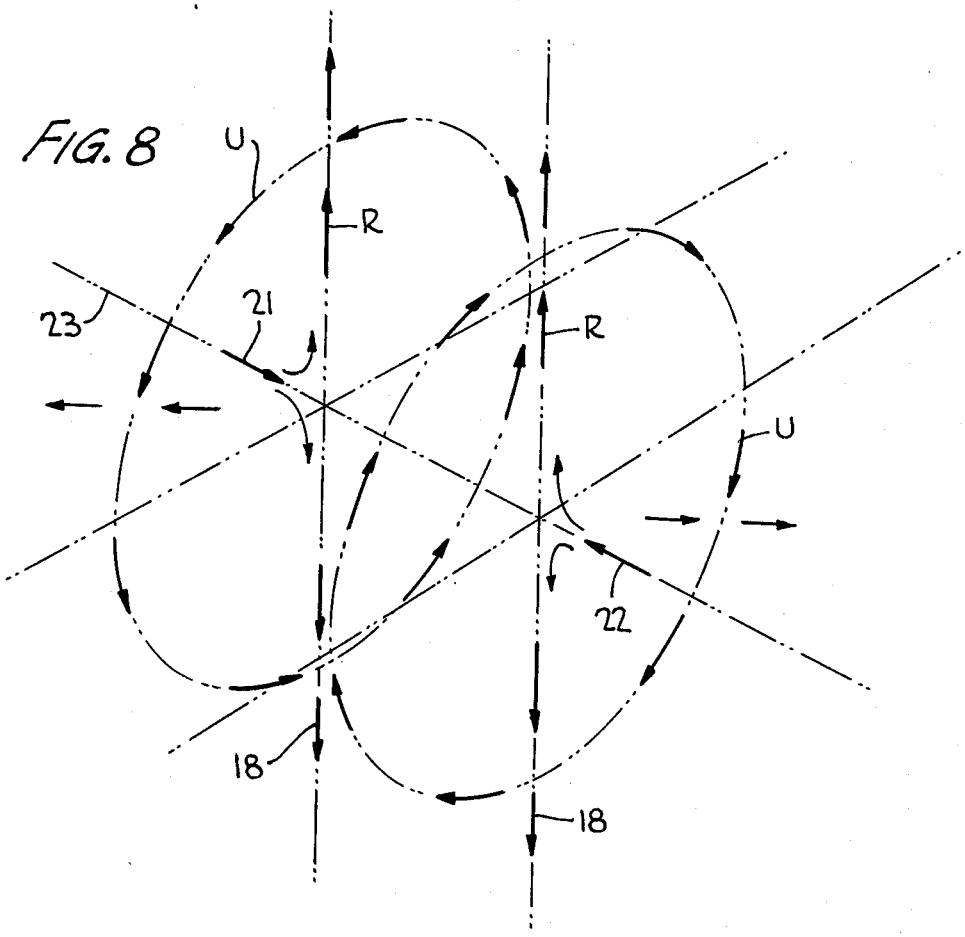

An example of the manner in which the desired flows can be produced is shown schematically in FIGS. 7 and 8. FIG. 7 illustrates one thread of a stream 21 or 22 of two streams of media, which at first flow toward each other within the arrangement along axis 23 and are then deflected outwardly in a radial direction. Just before contacting one another, as shown, they are reversed by vanes 30 and 31, or the like, in a peripheral direction, but in a reverse rotational direction, as indicated by arrows 24 and 25.

In FIG. 8, the overall flow conditions are illustrated schematically with regard to movement. The two streams of media, as symbolized by threads 21 and 22 of the streams, first rotate in opposite directions within the arrangement, flow toward each other along axis 23, and are deflected radially outwardly. Their peripheral components U are far larger than their radial components R, which are equally large by pairs for both streams of media. The turbulent stream of medium developed after contact of the two streams of media flows radially outwardly in all directions as indicated by arrows 18.

Obviously, many other modifications and variations of the present invention are made possible in the light of the above teachings. It is therefore to be understood that within the scope of the appended claims the invention may be practiced otherwise than as specifically described.

What is claimed is:

1. A process for producing a strong turbulence in at least one fluid or quasi-fluid medium including the steps of, guiding the medium for stream flow along at least two confined and adjacent stream paths without intermingling, rotating the two streams in opposite directions within their respective stream paths so as to cause the flow components of the two streams to be directed opposite to one another, and causing the streams to laterally graze each other within a discharge chamber as the streams begin to move outwardly of their paths, the streams being suddenly brought into contact with each other within the discharge chamber whereupon intensive movements of the medium particles develop transversely to the flow directions along fictitious planes of contact between the two streams as the result of a delay in speed of the flow components of the streams directed opposite one another, whereby a strong turbulence develops with a most intimate mixing of the two streams.

2. The process according to claim 1 wherein the flow components of one stream are at least equally as great as the flow components of the other stream.

3. The process according to claim 1 including the further step of rotating and radially directing the flow components of one of the streams.

4. The process according to claim 1 wherein both streams are rotated about a common axis in opposite directions.

5. The process according to claim 1 wherein one of the streams is so rotated that its peripheral flow components are greater than the radial flow components thereof.

6. The process according to claim 1 including the further step of carrying away the turbulent stream of the medium developed through the intermixing in a direction deviating from the stream paths.

7. The process according to claim 1 wherein the two streams are rotated at the same speed.

8. The process according to claim 1 wherein two fluid or quasi-fluid media are each guided for stream flow respectively along at least the two confined and adjacent stream paths, the flow energy $m_1v_1^2$ of one of the media is equally as great as the flow energy $m_2v_2^2$ of the other media, wherein $m_1$ and $m_2$ designate the masses of the two media and $v_1$, $V_2$ designate their flow velocity prior to contact.

9. An arrangement for the production of a strong turbulence in at least one fluid or quasi-fluid medium comprising, at least one pair of adjacent flow channels for guiding the medium therealong in at least two stream paths without intermingling, means for rotating the streams in opposite directions within their respective flow chambers so that the flow components thereof are directed opposite one another, a discharge chamber being provided outwardly and adjacent the flow channels, the streams laterally grazing each other at the opening of the discharge chamber as they begin to move radially outwardly of their flow channels, the streams being suddenly brought into contact with each other within the chamber whereupon intensive movements of the medium particles develop transversely to the flow directions along fictitious planes of contact between the two streams as the result of a delay in speed of the flow components of the streams directed opposite one another, whereby a strong turbulence develops with a most intimate mixing of the two streams.

10. The arrangement according to claim 9 wherein the flow channels are formed by means of three parallel and spaced, circular discs having a common axis, the middle one of said discs having a smaller diameter as compared to the outer discs, the two streams flowing respectively between said middle disc and said outer discs in opposite directions, the two streams flowing radially outwardly toward the peripheral edge of said middle disc and, at said edge, the two streams laterally graze each other whereafter the streams suddenly contact one another within said discharge chamber formed between said outer discs outwardly of said edge.

11. The arrangement according to claim 10 wherein the walls of said chamber are made of catalytic material.

12. The arrangement according to claim 10 wherein the walls of said chamber form heat exchange surfaces of a heat exchanger.

* * * * *